US006384378B2

(12) United States Patent
Natsuhara et al.

(10) Patent No.: US 6,384,378 B2
(45) **Date of Patent: *May 7, 2002**

(54) CERAMIC HEATER FOR TONER-FIXING UNITS AND METHOD FOR MANUFACTURING THE HEATER

(75) Inventors: Masuhiro Natsuhara; Hirohiko Nakata, both of Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/834,642

(22) Filed: Apr. 16, 2001

(30) Foreign Application Priority Data

May 10, 2000 (JP) ..... 2000-136621
Aug. 8, 2000 (JP) ..... 2000-239281

(51) Int. Cl.[7] ..... H05B 3/00

(52) U.S. Cl. ..... 219/216; 219/543; 399/335; 338/308

(58) Field of Search ..... 219/216, 469–471; 118/60; 399/328–335; 432/60, 228; 492/46; 338/308

(56) References Cited

U.S. PATENT DOCUMENTS 6,078,027 A * 6/2000 Natsuhara et al. ..... 219/216
6,122,478 A * 9/2000 Hirst ..... 399/330
6,157,806 A * 12/2000 Elbert et al. ..... 399/329
6,185,383 B1 * 2/2001 Kanari et al. ..... 399/45
6,222,158 B1 * 4/2001 Nakata et al. ..... 219/216
6,223,017 B1 * 4/2001 Akutsu et al. ..... 399/330
6,246,035 B1 * 6/2001 Okuda ..... 219/619
6,276,793 B1 * 8/2001 Kazakos et al. ..... 347/102

FOREIGN PATENT DOCUMENTS

JP 63313182 A 12/1988
JP 01263679 A 10/1989
JP 02157878 A 6/1990
JP 09080940 A 3/1997
JP 09197861 A 7/1997

* cited by examiner

*Primary Examiner*—Teresa Walberg
*Assistant Examiner*—Shawntina Fuqua
(74) *Attorney, Agent, or Firm*—McDermott, Will & Emery

(57) ABSTRACT

A ceramic heater that is used in a toner-fixing system comprising a ceramic heater and a heat-resistant film, that reduces the degree of deformation of the heat-resistant film, that lightens the load applied to the film at the time of revolution, that prevents the fracture of the film, and that enables fixing at a high rate exceeding 24 ppm. A ceramic base material 11 of the ceramic heater attached to a heating cylinder comprises aluminum nitride or silicon nitride. A heating element 12 and current-feeding electrodes are made of heat-resistant metal such as tungsten and molybdenum or heat resistant alloy and are formed on the ceramic base material. In the ceramic heater, at least one part of the face (the fixing face) that contacts the heat-resistant film is curved when viewed from a direction perpendicular to the feeding direction of a copying sheet.

9 Claims, 4 Drawing Sheets

(A-1)

(A-2)

CERAMIC HEATER FOR TONER-FIXING UNITS AND METHOD FOR MANUFACTURING THE HEATER

BACKGROUND OF THE INVENTION

1. Field of the Invention

The present invention relates to a heating-type toner-fixing unit in which (a) a pressure roller drives a continuous heat-resistant film by pressing it against a ceramic heater positioned on a heating cylinder and (b) a toner image is fixed on a copying sheet fed between the pressure roller and the heat-resistant film. The present invention particularly relates to a ceramic heater for a toner-fixing unit in which the ceramic heater is positioned on a heating cylinder.

2. Related Background Arts

Toner-fixing units used in fax machines, copiers, printers, and other image-forming machines transfer a toner image formed on a photosensitive drum onto a sheet of paper or another copying sheet before fixing it on the surface of the sheet by concurrent heating and pressing.

These toner-fixing units comprise a heating roller and a plastic pressure roller. One of these units, for example, uses a cylindrical metal roller provided with a halogen lamp or another heat source as the heating roller so that the surface region of the metal roller is heated by the heat source to fix the toner.

In addition to this fixing system, another toner-fixing system has been offered and used in recent years which uses a ceramic heater (hereinafter also simply called "a heater") without using a heating roller. The latter system has been disclosed in published Japanese patent applications Tokukaihei 1-263679, Tokukaihei 2-157878, and Tokukaishou 63-313182, for example. Specifically, these disclosed systems (a) mount a ceramic heater on a plastic support, (b) use a pressure roller to press a heat-resistant film against the ceramic heater so that the heat-resistant film can move at the same speed as the peripheral speed of the pressure roller to feed a sheet of paper, and (c) fix a toner image on the surface of the sheet. The heat-resistant film is composed of a material comprising heat-resistant plastic, metal, or both.

The latter fixing system, using a toner-fixing unit comprising a ceramic heater and a heat-resistant film, has a heater significantly smaller in thermal capacity than that of the former system, using a metal roller. Therefore, the latter system can reduce the power consumption and eliminate the preheating of the heater after the power is supplied, so it is advantageous in having an excellent quick-start property.

FIG. 1 schematically shows a modified latter fixing system in which a continuous heat-resistant film revolves around a heating cylinder. In FIG. 1, a ceramic heater 1 is positioned on a heating cylinder 2. A continuous heat-resistant film 3 revolves on the periphery of the heating cylinder 2. A pressure roller 4 has a rubber layer or another elastic layer formed on its periphery and its rotation revolves the heat-resistant film 3 at the same speed as its peripheral speed. The heating cylinder 2 and the pressure roller 4 are pressed against each other by springs (not shown in FIG. 1) provided at the fixed portions of both of their ends. This pressure deforms the elastic layer on the periphery of the pressure roller 4, forming a nip portion 5 having a width of W. A toner image 6*a* is formed on a copying sheet 6 such as a sheet of paper. The copying sheet 6 is fed between the heat-resistant film 3 and the pressure roller 4 each rotating in the direction of the arrow. The toner image 6*a* on the copying sheet 6 is heated and pressed at the nip portion 5 to be fixed as an image 6*b*.

The ceramic heater 1 attached to the heating cylinder 2 has a structure shown schematically in FIG. 2, for example. FIG. 2 is a plan view viewed from the downside. In FIG. 2, a ceramic base material 11 supports (a) one or more heating elements 12 provided at the face (tile fixing face) where the ceramic heater 1 is positioned opposite to the pressure roller 4 via the heat-resistant film 3 and (b) current-feeding electrodes 13 for supplying electric power to the heating elements 12. The ceramic base material 11 generally has a shape of a thin rectangular flat plate as a whole. Generally, the heating elements 12 are formed at the fixing-face side of the ceramic heater 1, and an overcoat glass layer is formed on the heating elements as a protective layer. The glass layer not only ensures electrical insulation but also protects the heating elements 12 and other members against the sliding contact with the heat-resistant film 3.

Alumina is generally used now as the ceramic base material 11 of the foregoing ceramic heater 1. The ceramic heaters using alumina base materials in this image-fixing system have a fixing rate of 6 to 16 ppm. The unit "ppm" is the abbreviation of "papers per minute" and signifies the number of sheets of paper in A4 size (210×297 mm) fed in a minute. The foregoing fixing rate, however, no longer satisfies the market's requirement. The market now requires to increase the rate to 24 ppm or more.

In a ceramic heater in this image-fixing system, a voltage of 100 or 200 V is applied to the heating elements to produce a Joule heat of hundreds of watts or more. This heat raises the temperature to about 200° C. in 2 to 6 seconds. In this rapid heating process, ceramic heaters using alumina base materials pose a problem of fracture caused by heat shock. When the fixing rate is increased, the time for transferring the heat from the heater to a sheet of paper (a copying sheet) is shortened. This requires the increase in the amount of heat to be supplied from the heater to the copying sheet per unit time, because the toner fixing requires a certain amount of heat. As a result, the increase in the fixing rate tends to increase the heat shock applied to the heater, increasing the percentage of heater fracture.

In order to cope with this problem, ceramic heaters using aluminum nitride, which has excellent resistance to heat shock, as the base material have been disclosed in published Japanese patent applications Tokukaihei 9-80940 and Tokukaihei 9-197861. Tokukaihei 9-80940 improves the temperature responsivity of the heater by exploiting the fact that aluminum nitride has a higher thermal conductivity than alumina. Tokukaihei 9-197861 intends to improve the fixing quality, to increase the possibility of high-speed printing, and to reduce the power consumption by utilizing the highly heat-conductive quality of aluminum nitride.

As stated above, the use of aluminum nitride as the base material of the ceramic heater can solve the problem of heater fracture. However, further increase in the fixing rate poses another problem of a reduction in the durability of the heat-resistant film (hereinafter also simply called "film") revolving around the heating cylinder provided with the ceramic heater.

As mentioned previously, the conventional ceramic heater has a shape of a rectangular flat plate as a whole. Consequently, the continuous heat-resistant film, which is tubular when viewed from the side, is pressed against the flat fixing face provided on the heating cylinder by the pressure roller and deformed to a flat shape at this position, the nip portion. This deformation accompanied by the high-speed revolution applies a heavy load to the film and may cause the film to fracture at an early stage. In particular, a fixing rate exceeding 24 ppm increases this tendency. This problem has been an obstacle for increasing the fixing rate in a system using a heat-resistant film and a ceramic heater.

SUMMARY OF THE INVENTION

Considering the above-described problems, an object of the present invention is to offer an improved ceramic heater for a fixing system using a heat-resistant film and a ceramic heater. The ceramic heater is characterized by the following features:

(a) it reduces the degree of deformation of the heat-resistant film to lighten the load applied to the film at the time of revolution;

(b) it thereby lengthens the lifetime of the film, i.e., the time that elapses before the film fractures;

(c) it suppresses the above-described problems of the heater; and (d) it enables high-rate fixing exceeding 24 ppm.

The ceramic heater offered by the present invention is used for a toner-fixing unit, which comprises:

(a) a heating cylinder provided with a ceramic heater along the longitudinal direction of its outer surface;

(b) a continuous heat-resistant film revolving along the periphery of the heating cylinder; and (c) a pressure roller that forms a nip portion together with the heat-resistant film at the outer region opposite to the ceramic heater on the heating cylinder and that rotates to revolve the heat-resistant film at the same speed as the peripheral speed of the pressure roller.

The toner-fixing unit feeds a copying sheet to the nip portion by the revolution of the heat-resistant film and the pressure roller and fixes a toner image on the copying sheet by the pressure of the pressure roller, and the heat from the ceramic heater on the heating cylinder.

In order to achieve the foregoing object, the ceramic heater of the present invention comprises a ceramic base material, a heating element, and current-feeding electrodes. The heating element and current-feeding electrodes are made of heat-resistant metal or heat-resistant alloy and formed on the ceramic base material. In the ceramic base material, at least one part of the face that contacts the heat-resistant film is curved when viewed from a direction perpendicular to the feeding direction of the copying sheet.

The method for manufacturing the ceramic heater of the present invention is a method for manufacturing the ceramic heater to be used in the foregoing toner-fixing unit. A ceramic base material is extrusion-formed in such a manner that at least one part of the face that contacts the heat-resistant film is curved when viewed from a direction perpendicular to the feeding direction of the copying sheet. A heating element or current-feeding electrodes are printed with heat-resistant metal pastes or heat-resistant alloy pastes on the formed body at the face where the formed body contacts the heat-resistant film or at the reverse side of the face, and the formed body with the heating element and the current feeding electrodes is sintered.

The present invention reduces the degree of deformation of the heat-resistant film to lighten the load applied to the film at the time of revolution, so that the fracture of the film can be prevented. As a result, the heat-resistant film can be used at a fixing rate exceeding 24 ppm, which cannot be realized by the prior art. Consequently, the present invention enables the realization of a fixing system that uses a ceramic heater and a heat-resistant film, that consumes fixing power as low as the conventional system, and that can fix images at a high rate exceeding 24 ppm.

DETAILED DESCRIPTION

Figure 1:
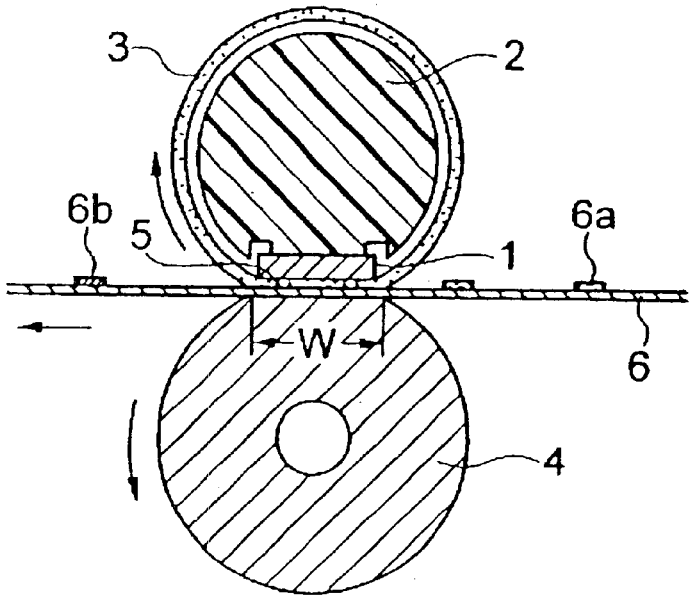
FIG. 1 is a sectional view schematically showing a toner-fixing unit based on a fixing system using a ceramic heater and a heat-resistant film.
Figure 2:
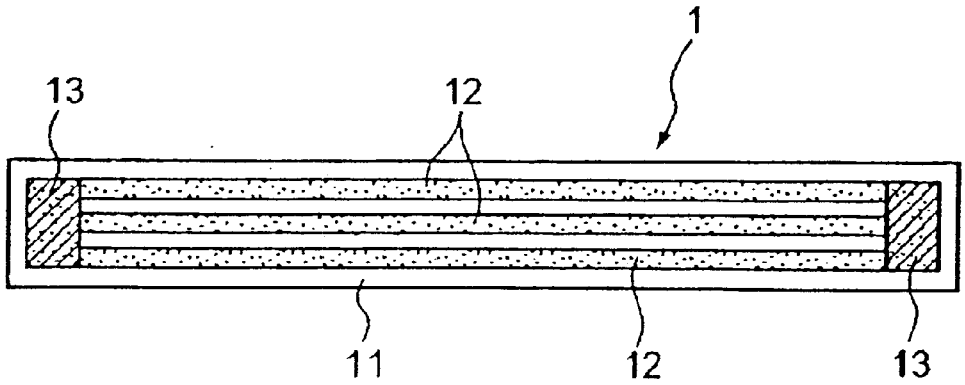
FIG. 2 is a plan view schematically showing a ceramic heater when viewed from the fixing-face side.

In the ceramic heater of the present invention attached to a heating cylinder, at least one part of the face (hereinafter also called the fixing face) that contacts the heat-resistant film is curved when viewed from a direction perpendicular to the feeding direction of the copying sheet. Such a curved portion in the fixing face of the ceramic heater can reduce the sliding load of the heat-resistant film. At the same time, the degree of the deformation of the heat-resistant film can be reduced. As a result, the durability of the heat-resistant film can be improved.

As for a specific curved shape of a fixing face, it is desirable that all the adjoining curves be connected smoothly with one another at a cross section when viewed from a direction perpendicular to the feeding direction of the copying sheet. For example, it is desirable that the whole of the fixing face of a ceramic heater form a circular arc. It is more desirable that the whole of the outside surface of a ceramic base material to be used as the fixing face of a ceramic heater have a curved shape having much the same radius of curvature as that of the heat-resistant film. This condition can minimize the degree of deformation of the heat-resistant film, thus preventing most of the fracture of the heat-resistant film. If the fixing face of the ceramic heater has a radius of curvature larger than that of the heat-resistant film, the nip portion increases its width, improving the fixing quality. However, this condition tends to shorten the lifetime of the film, depending on the feeding speed. Therefore, notwithstanding that the fixing face of the ceramic heater may have a radius of curvature slightly larger than that of the heat-resistant film, it is necessary to obtain a proper combination of the radius of curvature and the feeding speed of the copying sheet.

When it is desired to further improve the fixing quality, it is possible to design the ceramic heater in the following manner: In order to increase the contact area between the pressure roller, the heat-resistant film, and the ceramic heater, the fixing face of the ceramic heater can have a circular arc in the opposite direction to that of the heating cylinder. The circular arc can also have a radius of curvature the same as or larger than that of the opposite pressure roller. When it is desired to increase the lifetime of the heat-resistant film in addition to the improvement of the fixing quality, the ceramic heater can have a flat shape at the nip portion in order to secure the specified nip width and curved shapes at portions other than the nip portion in the fixing face.

When the ceramic base material of a ceramic heater has a sufficient thickness to endure the cycles of pressure and heat in operation at both ends in the foregoing cross section and has an average thickness nearly the same as that of the conventional heater in the cross section, the ceramic heater can have nearly the same thermal capacity as that of the conventional heater. This condition can improve the durability of the heat-resistant film without adversely affecting the properties such as power consumption and start-up time. Some of the concrete examples of the cross-sectional shape in the ceramic heater of the present invention are shown schematically in FIGS. 3 to 8. As can be seen from these figures, a heating element 12 can be formed either at the fixing-face side or at the back-face side of a ceramic base material 11 (the reverse side of the fixing face, shall hereinafter be referred to as "the back face" in the present invention).

It is desirable that the ceramic base material for a ceramic heater be a ceramic consisting mainly of aluminum nitride or silicon nitride, both of which are highly heat conductive. An aluminum nitride-based ceramic has higher thermal conductivity than alumina and high-resistance to heat shock. Consequently, even when a rapid temperature rise in a heating element at the time of fixing applies a large thermal shock to a ceramic heater, the heater can be immune to fracture. Although low in thermal conductivity in comparison with an aluminum nitride-based ceramic, a silicon nitride-based ceramic has extremely high mechanical strength. Therefore, a heater made of this ceramic material has minimal fracture by heat shock.

Nevertheless, when the fixing rate is 24 ppm or less, which produces a comparatively small heat shock, an alumina-based ceramic heater can be used provided that the heater has the curved shape specified by the present invention. A heat-resistant film, which moves in contact with a ceramic heater, can be composed of heat-resistant plastic, metal, or a combination of these as with the conventional heat-resistant film.

A method for manufacturing the ceramic heater of the present invention, having a curved fixing face, is explained below. In the present invention, a formed body is produced by extruding a kneaded body for a ceramic base material in such a manner that the face (the fixing face) that is to be positioned opposite to the pressure roller via the heat-resistant film has a specified curved shape. A heating element and current-feeding electrodes are printed with heat-resistant metal pastes or heat-resistant alloy pastes on the formed body at the fixing face or at the back face. A ceramic heater with a heating element and current-feeding electrodes on a base material is obtained by simultaneously sintering the formed body, the heating element and the current-feeding electrodes in a non-oxidation atmosphere (the co-firing method).

Although the method for forming the ceramic base material is not particularly limited, it is desirable to use an ordinary extrusion-forming method. The extrusion-forming method enables the inexpensive formation of a ceramic sintered body having a curved shape in comparison with the mechanical machining. In addition to the extrusion-forming method, it is possible to provide a sheet by the doctor-blade method to give a curved shape to the sheet by heating at a temperature of 50° C. or higher. However, this method tends to be more costly than the extrusion-forming method, because it requires an additional process of altering the shape by heating.

Tungsten, molybdenum or alloys of these metals are used as the material of the heating element and the current-feeding electrodes. These heat-resistant metals and alloys are suitable as the material for the co-firing method of this invention because they can be sintered at the sintering temperature of ceramic. Metals can be plated on the current-feeding electrodes to reduce the electric resistance of the current-feeding electrodes. The metals for plating are not especially limited, but nickel or gold is desirable from the viewpoint of oxidation resistance and heat resistance.

It is desirable that an abrasion-resistant protective layer be provided on the fixing face of the ceramic base material, which face contacts the heat-resistant film. In particular, when the heating element and current-feeding electrodes are formed on the fixing-face side, it is desirable to form thereupon an abrasion-resistant protective layer in order to secure the electrical insulation as well as protect them from the sliding movement of the heat-resistant film. It is preferable that the composition of the foregoing protective layer is almost the same as the ceramic base material approximately. The protective layer is formed by printing or painting ceramic paste, and sintering. With the foregoing process, it is possible to sinter the protective layer simultaneously at the same temperature as the sintering temperature of the heating element and the current-feeding electrodes.

A more desirable abrasion-resistant protective layer is a diamond-like carbon (DLC) layer. A DLC layer not only has excellent resistance to abrasion but also a significantly higher thermal conductivity than a glass layer (whereas the thermal conductivity of glass is several in the unit of W/(m·K), that of DLC is several hundreds in the unit of W/(m·K)). Therefore, a DLC layer can offer a more uniform temperature distribution, enabling further improvement of the fixing quality. A DLC layer can be formed by the well-known chemical or physical vapor deposition method.

EXAMPLE 1

The following constituent materials were kneaded with a kneader: a 100 wt. parts aluminum nitride powder; a sintering agent composed of a 0.3 wt. parts calcium oxide powder, a 1.5 wt. parts neodymium oxide powder, and a 1.5 wt. parts ytterbium oxide powder; a binder; and an organic solvent. The kneaded body was divided into six groups. Each group of the kneaded bodies was extrusion-formed in such a manner that the face (the fixing face) to be positioned opposite to the pressure roller via the heat-resistant film had a shape different from one another after the sintering. The different shapes are referred to as A to F as mentioned below.

On the fixing face or the back face of each aluminum nitride formed body obtained, W pastes for a heating element and current-feeding electrodes were screen-printed. Pastes for the protective layer were obtained by adding organic solvent and binder to powders having the same composition as the formed body, and printed and painted on the fixing face of the formed body. The whole bodies were degreased at 800° C. in a nitrogen atmosphere and were sintered in a nitrogen atmosphere. Thus, individual ceramic heaters made of aluminum nitride were produced. The base material had a thermal conductivity of 150 W/(m·K) and a three-point bending strength of 30 MPa (bending strength was measured in accordance with Japanese Industrial Standard (JIS)).

Figure 3:
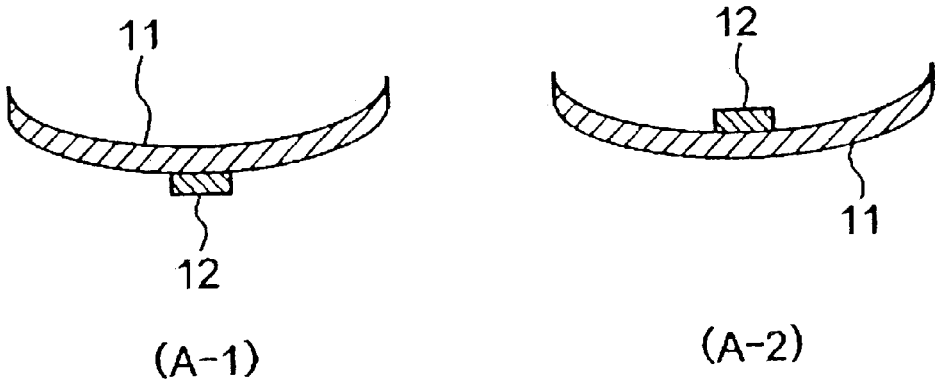
FIG. 3 is a sectional view showing a ceramic heater having a fixing face of "shape A" in an example.
Figure 4:
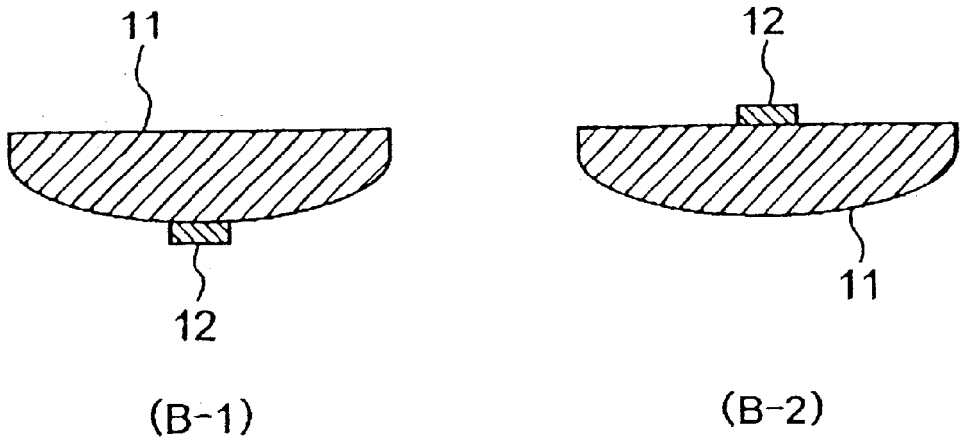
FIG. 4 is a sectional view showing a ceramic heater having a fixing face of "shape B" in an example.
Figure 5:
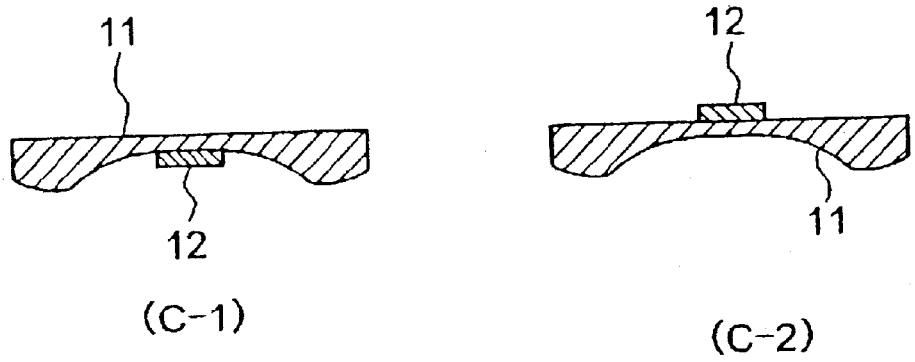
FIG. 5 is a sectional view showing a ceramic heater having a fixing face of "shape C" in an example.
Figure 6:
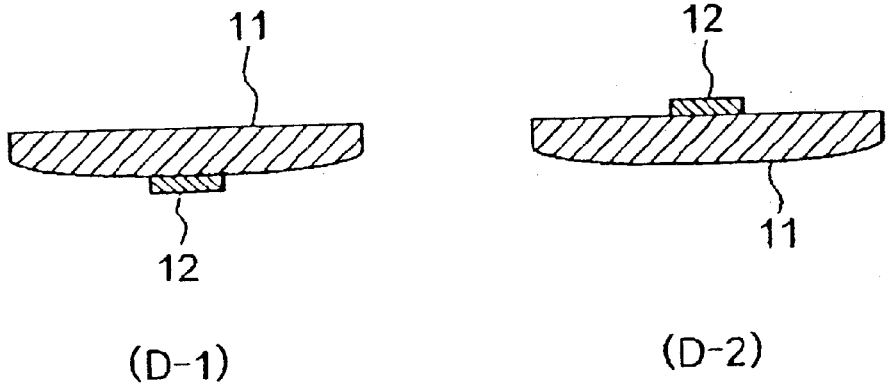
FIG. 6 is a sectional view showing a ceramic heater having a fixing face of "shape D" in an example.
Figure 7:
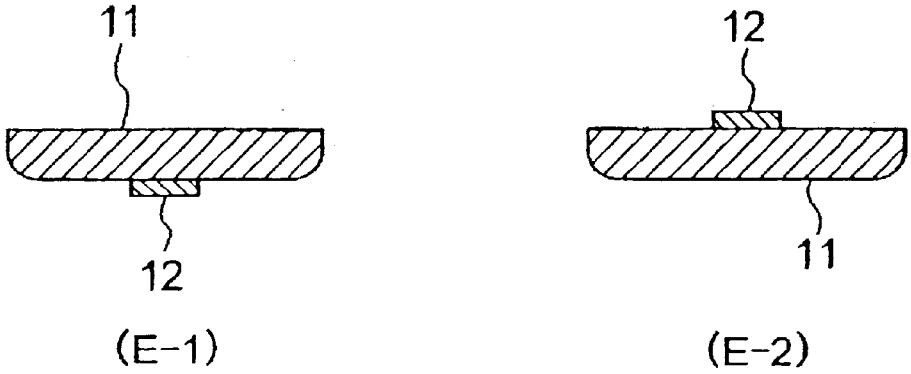
FIG. 7 is a sectional view showing a ceramic heater having a fixing face of "shape E" in an example.
Figure 8:
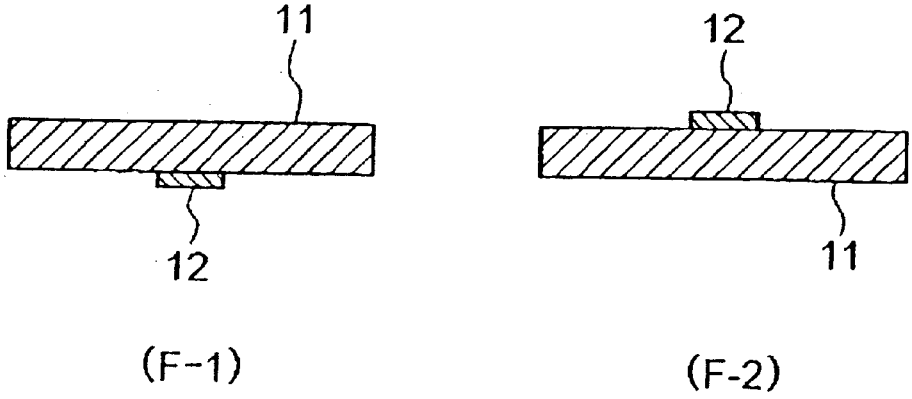
FIG. 8 is a sectional view showing a ceramic heater having a fixing face of "shape F" in a conventional example.

The shapes of the fixing faces of the ceramic heaters are classified as Shapes A to F when viewed from a direction perpendicular to the feeding direction of the copying sheet. FIGS. 3 to 8 schematically illustrate the cross sections of Shapes A to F when viewed from a direction perpendicular to the feeding direction of the copying sheet. FIGS. 3(A-1), 4(B-1), 5(C-1), 6(D-1), 7(E-1), and 8(F-1) show the configuration when the heating element is provided on the fixing face. FIGS. 3(A-2), 4(B-2), 5(C-2), 6(D-2), 7(E-2), and 8(F-2) show the configuration when the heating element is provided on the reverse side of the fixing face.

The shapes of the fixing faces of the ceramic heaters are as follows:

Shape A (FIG. 3): The base material has a circular arc having the radius of curvature R=20 mm both at the fixing face and at the back face. The center portion of the base material has a maximum thickness of 0.635 mm.

Shape B (FIG. 4): The base material has a thickness of 0.635 mm at both ends in the cross section. The fixing face has a circular arc having the radius of curvature R=20 mm. The back face has a flat surface.

Shape C (FIG. 5): The base material has a fixing face having a circular-arc-shaped concavity with the radius of curvature R=40 mm (i.e., the direction of the circular arc is opposite to that of the heating cylinder). The center portion of the base material has a minimum thickness of 0.635 mm. The back face has a flat surface.

Shape D (FIG. 6): The base material has on the fixing face a curved face having the radius of curvature R=30 mm at both ends in the cross section. The other portion of the fixing face is flat. The thickness of the base material at the portion other than the curved portions at both ends in the cross section is uniform at 0.635 mm. The back face has a flat surface.

Shape E (FIG. 7): The base material has on the fixing face a curved face having the radius of curvature R=0.5 mm at both ends in the cross section. The other portion of the fixing face is flat. The thickness of the base material at the portion other than the curved portions at both ends in the cross section is uniform at 0.635 mm. The back face has a flat surface.

Shape F (FIG. 8): The base material has a flat fixing face and a flat back face. The base material is a rectangular flat plate having a uniform thickness of 0.635 mm (a conventional example).

Each heater has a length of 300 mm and a width of 12 mm.

On individual ceramic heaters having a different shape from Shape A to Shape F in the fixing face, a continuous heat-resistant film that was made of heat-resistant plastic and that had a diameter of 40 mm was positioned to be incorporated into a toner-fixing unit. The film was in contact with a pressure roller having a diameter of 25 mm. Using the toner-fixing unit, the durability of the heat-resistant film was evaluated by rotating the pressure roller at the speed corresponding to a fixing rate of 40 ppm. The heater temperature was controlled to the minimum for obtaining satisfactory fixing quality under each evaluation condition. Ceramic heaters having a DLC protective layer in place of the foregoing glass protective layer were also examined (DLC has a thermal conductivity of 400 W/(m·E)). The obtained results are shown in Table I below.

TABLE I

| Sample | Base material | Shape of fixing face | Protective layer | Durability of heat-resistant film |
|---|---|---|---|---|
| 1 | AlN | A-1 | AlN | No fracture after 3,000 hrs. |
| 2 | AlN | A-1 | DLC | No fracture after 3,000 hrs. |
| 3 | AlN | A-2 | AlN | No fracture after 3,000 hrs. |
| 4 | AlN | A-2 | DLC | No fracture after 3,000 hrs. |
| 5 | AlN | B-1 | AlN | No fracture after 3,000 hrs. |
| 6 | AlN | B-1 | DLC | No fracture after 3,000 hrs. |
| 7 | AlN | B-2 | AlN | No fracture after 3,000 hrs. |
| 8 | AlN | B-2 | DLC | No fracture after 3,000 hrs. |
| 9 | AlN | C-1 | AlN | No fracture after 3,000 hrs. |
| 10 | AlN | C-1 | DLC | No fracture after 3,000 hrs. |
| 11 | AlN | C-2 | AlN | No fracture after 3,000 hrs. |
| 12 | AlN | C-2 | DLC | No fracture after 3,000 hrs. |
| 13 | AlN | D-1 | AlN | No fracture after 3,000 hrs. |
| 14 | AlN | D-1 | DLC | No fracture after 3,000 hrs. |
| 15 | AlN | D-2 | AlN | No fracture after 3,000 hrs. |
| 16 | AlN | D-2 | DLC | No fracture after 3,000 hrs. |
| 17 | AlN | E-1 | AlN | Fracture after 1,700 hrs. |
| 18 | AlN | E-1 | DLC | Fracture after 1,800 hrs. |
| 19 | AlN | E-2 | AlN | Fracture after 1,800 hrs. |
| 20 | AlN | E-2 | DLC | Fracture after 1,850 hrs. |
| 21* | AlN | F-1 | AlN | Fracture after 1,050 hrs. |
| 22* | AlN | F-1 | DLC | Fracture after 1,150 hrs. |
| 23* | AlN | F-2 | AlN | Fracture after 1,000 hrs. |
| 24* | AlN | F-2 | DLC | Fracture after 1,050 hrs. |

*Conventional example.

The results demonstrate that the ceramic base material having a curved fixing face significantly improves the durability of the heat-resistant film in comparison with the conventional ceramic base material having a rectangular flat-plate shape. In particular, the samples having Shapes A and B, in which the whole fixing face is composed of a circular arc, and the samples having Shapes C and D show no fracture even after 3,000 hours of continuous operation at a rate as high as 40 ppm. These samples have excellent durability.

Next, some of the ceramic heaters were used to evaluate (a) the warming-up time required before fixing after the current feeding to the heater and (b) the power consumption required to fix the image on a sheet of copying paper at a fixing rate of 40 ppm. The results are shown in Table II below.

TABLE II

| Sample | Base material | Shape of fixing face | Protective layer | Warming-up time (seconds) | Power consumption (Wh) |
|---|---|---|---|---|---|
| 1 | AlN | A-1 | AlN | 2.2 | 1.36 |
| 5 | AlN | B-1 | AlN | 3.6 | 1.78 |
| 9 | AlN | C-1 | AlN | 3.2 | 1.51 |
| 13 | AlN | D-1 | AlN | 2.0 | 1.25 |
| 17 | AlN | E-1 | AlN | 2.2 | 1.31 |
| 21* | AlN | F-1 | AlN | 2.1 | 1.33 |

*Conventional example.

The results demonstrate that the ceramic heaters of the examples of the present invention have nearly the same warming-up time and power consumption as those of the heater of the conventional example. However, the ceramic heater of Sample 5 having Shape B, which is thick as a whole, requires slightly higher power consumption, because of its larger thermal capacity. The ceramic heater of Sample 9 has Shape C, whose center portion has a minimum thickness of 0.635 mm. The heater has a larger thermal capacity than the conventional heater having Shape F, because Shape C has a larger volume caused by the additional circular-arc portion (Shape F has a uniform thickness of 0.635 mm). As a result, the heater requires a longer warming-up time and higher power consumption for fixing the image on a sheet of copying paper.

Next, some of the ceramic heaters of the examples of the present invention were used to evaluate the difference in fixing quality between the AlN protective layer and the DLC protective layer. The obtained results are shown in Table III below. In the column under "fixing quality" in Table III, "◎" signifies that when the fixed image was scraped with a piece of paper, the toner showed no falling-off, demonstrating the excellent fixing quality; "○" signifies that when tested by the same method, the toner showed a permissible small amount of failing-off, demonstrating the absence of a problem in practical application. As can be seen from Table III, the DLC protective layer has superior fixing quality compared to the AlN protective layer, because DLC has a higher thermal conductivity.

TABLE III

| Sample | Base material | Shape of fixing face | Protective layer | Fixing quality |
|---|---|---|---|---|
| 1 | AlN | A-1 | AlN | ○ |
| 2 | AlN | A-1 | DLC | ◎ |
| 5 | AlN | B-1 | AlN | ○ |
| 6 | AlN | B-1 | DLC | ◎ |

EXAMPLE 2

As with Example 1, ceramic heaters were produced that have Shapes A to F for their fixing faces and that have ceramic base materials comprising silicon nitride or aluminum. As for the silicon nitride ceramic heater, the following constituent materials were kneaded: a 100 wt. parts silicon nitride powder; a sintering agent composed of a 5 wt. parts yttrium oxide powder and a 2 wt. parts alumina powder; a binder; and an organic solvent. The kneaded body was used to produce formed bodies by a procedure similar to that in Example 1. As with Example 1, W pastes for a heating element and current-feeding electrodes were screen-printed on the formed body. Protective layers were printed with pastes obtained by adding organic solvent and binder to powders having the same composition as the formed body made of silicon nitride. The whole bodies were dried, degreased at 800° C. in a nitrogen atmosphere, and sintered at 1,800° C. in a nitrogen atmosphere to complete ceramic heaters made of silicon nitride. The silicon nitride ceramic heater had a thermal conductivity of 100 W/(m·K) and a three-point bending strength of 100 MPa (bending strength was measured in accordance with JIS).

As for the alumina ceramic heater, the following constituent materials were kneaded: a 100 wt. parts alumina powder; a sintering agent composed of a 3 wt. parts magnesium oxide powder, a 2 wt. parts calcium oxide powder, and a 1 wt. parts silicon dioxide powder; a binder; and an organic solvent. The kneaded body was used to produce formed bodies by a procedure similar to that in Example 1. As with Example 1, W pastes for a heating element and current-feeding electrodes were screen-printed on the formed body. Protective layers were printed with pastes obtained by adding organic solvent and binder to powders having the same composition as the formed body made of alumina. The whole bodies were dried, degreased at 800° C. in a nitrogen atmosphere, and sintered at 1,600° C. in a nitrogen atmosphere to complete ceramic heaters made of alumina. The alumina ceramic heater had a thermal conductivity of 20 W/(m·K) and a three-point bending strength of 40 MPa (the bending strength was measured in accordance with JIS).

On the silicon nitride ceramic base materials and the alumina ceramic base materials thus obtained, Ag current-feeding electrodes, Ag—Pd heating elements, and borosilicate-glass protective layers were formed by a procedure similar to that in Example 1. Thus, ceramic heaters made of either silicon nitride or aluminum were produced.

As comparative examples, on an extrusion-formed body made of silicon nitride and an extrusion-formed body made of alumina each having the same composition as above, tungsten pastes for the heating element and current-feeding electrodes were screen-printed and a paste having the same composition as each formed body was applied as a protective layer. They were degreased at 800° C. in a nitrogen atmosphere and sintered at 1,800° C. in a nitrogen atmosphere. The obtained ceramic heaters made of either silicon nitride or aluminum had a warp of 0.5 mm at the maximum. Although this degree has no adverse effect on the practical use, the degree itself is larger than that of the ceramic heater of the present invention.

On individual ceramic heaters that have a ceramic base material made of either silicon nitride or aluminum and that have a different shape from Shape A to Shape F in the fixing face, a continuous heat-resistant film having a diameter of 40 mm was positioned to be incorporated into a toner-fixing unit. The film was in contact with a pressure roller having a diameter of 25 mm. Using the toner-fixing unit, the durability of the heat-resistant film was evaluated by rotating the pressure roller at the speed corresponding to a fixing rate of 40 ppm. The obtained results are shown in Table IV.

TABLE IV

| Sample | Base material | Shape of fixing face | Protective layer | Durability of heat-resistant film |
|---|---|---|---|---|
| 25 | $Al_2O_3$ | A-2 | $Al_2O_3$ | No fracture after 3,000 hrs. |
| 26 | $Si_3N_4$ | A-2 | $Si_3N_4$ | No fracture after 3,000 hrs. |
| 27 | $Al_2O_3$ | B-2 | $Al_2O_3$ | No fracture after 3,000 hrs. |
| 28 | $Si_3N_4$ | B-2 | $Si_3N_4$ | No fracture after 3,000 hrs. |
| 29 | $Al_2O_3$ | C-2 | $Al_2O_3$ | No fracture after 3,000 hrs. |
| 30 | $Si_3N_4$ | C-2 | $Si_3N_4$ | No fracture after 3,000 hrs. |
| 31 | $Al_2O_3$ | D-2 | $Al_2O_3$ | No fracture after 3,000 hrs. |
| 32 | $Si_3N_4$ | D-2 | $Si_3N_4$ | No fracture after 3,000 hrs. |
| 33 | $Al_2O_3$ | E-2 | $Al_2O_3$ | Fracture after 1,600 hrs. |
| 34 | $Si_3N_4$ | E-2 | $Si_3N_4$ | Fracture after 1,450 hrs. |
| 35 | $Al_2O_3$ | F-2 | $Al_2O_3$ | Fracture after 980 hrs. |
| 36 | $Si_3N_4$ | F-2 | $Si_3N_4$ | Fracture after 920 hrs. |

Note: Samples 35 and 36 are conventional examples.

The results demonstrate that also, in the case of the ceramic heaters made of either alumina or silicon nitride, the ceramic heater having a curved fixing face increases the lifetime of the heat-resistant film in comparison with the conventional example.

What is claimed is:

1. A ceramic heater for a toner-fixing unit which unit:

(a) comprises:

(a1) a heating cylinder provided with a ceramic heater along the longitudinal direction of the outer surface of the cylinder;

(a2) a continuous heat-resistant film revolving along the periphery of the heating cylinder; and (a3) a pressure roller that forms a nip portion together with the heat-resistant film at the outer region of the roller opposite to the ceramic heater on the heating cylinder and that rotates to revolve the heat-resistant film at the same speed as the peripheral speed of the pressure roller;

(b) feeds a copying sheet to the nip portion by the revolution of the heat-resistant film and the pressure roller; and (c) fixes a toner image on the copying sheet by the pressure of the pressure roller and the heat from the ceramic heater on the heating cylinder; the ceramic heater comprising:

(d) a ceramic base material in which at least one part of the face that contacts the heat-resistant film is curved when viewed from a direction perpendicular to the feeding direction of the copying sheet;

(e) a heating element, made of heat-resistant metal or heat-resistant alloy, formed on the ceramic base material; and (f) current-feeding electrodes, made of silver or silver alloy, formed on the ceramic base material.

2. The ceramic heater as defined in claim 1, wherein the whole of the face that contacts the heat-resistant film forms a circular arc.

3. A ceramic heater as defined in claim 1, wherein the face that contacts the heat-resistant film is provided with an abrasion-resistant protective layer.

4. The ceramic heater as defined in claim 3, wherein the abrasion-resistant protective layer comprises ceramic having almost the same composition as the ceramic base material.

5. The ceramic heater as defined in claim 3, wherein the abrasion-resistant protective layer comprises diamond-like carbon.

6. A ceramic heater as defined in claim 1, wherein the ceramic base material of the ceramic heater comprises an aluminum nitride-based ceramic.

7. A ceramic heater as defined in claim 1, wherein the ceramic base material of the ceramic heater comprises a silicon nitride-based ceramic.

8. A method for manufacturing a ceramic heater for a toner-fixing unit which unit:

(a) comprises:

(a1) a heating cylinder provided with a ceramic heater along the longitudinal direction of the outer surface of the cylinder;

(a2) a continuous heat-resistant film revolving along the periphery of the heating cylinder; and (a3) a pressure roller that forms a nip portion together with the heat-resistant film at the outer region of the roller opposite to the ceramic heater on the heating cylinder and that rotates to revolve the heat-resistant film at the same speed as the peripheral speed of the pressure roller;

(b) feeds a copying sheet to the nip portion by the revolution of the heat-resistant film and the pressure roller; and (c) fixes a toner image on the copying sheet by the pressure of the pressure roller and the heat from the ceramic heater on the heating cylinder;

the method comprising the steps of:

(d) extruding a material for a ceramic base material to obtain a formed body in a manner such that at least one part of the ceramic-base-material's face that contacts the heat-resistant film is curved when viewed from a direction perpendicular to the feeding direction of the copying sheet;

(e) printing a heating element and current-feeding electrodes with heat-resistant metal pastes or heat-resistant alloy pastes on the formed body at the face where the formed body contacts the heat-resistant film or at the back face; and (f) sintering the formed body with the heating element and the current-feeding electorodes.

9. The ceramic-heater-manufacturing method as defined in claim 8, wherein the face that contacts the heat-resistant film is provided with an abrasion-resistant protective layer.

* * * * *